US010040183B2

(12) United States Patent
Zhao

(10) Patent No.: US 10,040,183 B2
(45) Date of Patent: Aug. 7, 2018

(54) POWERED NAILER WITH POSITIVE PISTON RETURN

(71) Applicant: ILLINOIS TOOL WORKS INC., Glenview, IL (US)

(72) Inventor: Hanxin Zhao, Northbrook, IL (US)

(73) Assignee: Illinois Tool Works Inc., Glenview, IL (US)

( * ) Notice: Subject to any disclaimer, the term of this patent is extended or adjusted under 35 U.S.C. 154(b) by 485 days.

(21) Appl. No.: 14/467,802

(22) Filed: Aug. 25, 2014

(65) Prior Publication Data

US 2015/0102084 A1 Apr. 16, 2015

Related U.S. Application Data

(60) Provisional application No. 61/889,924, filed on Oct. 11, 2013.

(51) Int. Cl.

| | |
|---|---|
| ***B25C 1/12*** | (2006.01) |
| ***B25C 1/14*** | (2006.01) |
| ***B25C 1/08*** | (2006.01) |

(52) U.S. Cl.

CPC ..... *B25C 1/08* (2013.01)

(58) Field of Classification Search

CPC .. B25C 1/04; B25C 1/08; B25C 1/042; B25B 21/00; B25D 9/04

USPC ..... 227/10, 119, 130; 173/200

See application file for complete search history.

(56) References Cited

U.S. PATENT DOCUMENTS

| | | | | |
|---|---|---|---|---|
| 32,452 | A | 5/1861 | Phelps | |
| 3,708,096 | A * | 1/1973 | Burke, Jr. | B25C 1/043 227/130 |
| 3,891,036 | A * | 6/1975 | Schmidt | E21B 4/145 173/137 |
| 3,892,279 | A * | 7/1975 | Amtsberg | B25D 9/12 173/127 |

(Continued)

FOREIGN PATENT DOCUMENTS

| | | |
|---|---|---|
| EP | 0 252 653 | 1/1988 |

OTHER PUBLICATIONS

Canadian Office Action for Canadian Application No. 2,921,703, dated Dec. 19, 2016 (6 pages).

(Continued)

*Primary Examiner* — Robert Long

(74) *Attorney, Agent, or Firm* — Neal, Gerber & Eisenberg LLP

(57) ABSTRACT

A powered nailer includes a power source including a driving element reciprocating within a cylinder between a prefiring position and a fastener driving position, the latter occurring when the driving element engages a bumper disposed at the bottom of the cylinder. A reciprocating valve element defines a combustion chamber in fluid communication with the cylinder, and is configured for receiving a dose of fuel and air prior to a user-generated ignition. A return chamber at least partially surrounds the cylinder and is in fluid communication with the cylinder, being configured for receiving a supply of pressurized air generated by the driving element as it moves from the prefiring position to the fastener driving position, the pressurized air acting on an underside of the driving element for returning it to the pre-firing position.

9 Claims, 8 Drawing Sheets

(56) References Cited

U.S. PATENT DOCUMENTS 4,040,554 A * 8/1977 Haytayan ..... B25C 1/008 227/130
4,075,850 A * 2/1978 Nakazato ..... B25C 1/08 173/200
4,403,722 A 9/1983 Nikolich
4,483,473 A 11/1984 Wagdy
4,483,474 A 11/1984 Nikolich
4,522,162 A 6/1985 Nikolich
4,909,419 A * 3/1990 Yamada ..... B25D 9/14 227/1
4,913,331 A 4/1990 Utsumi et al.
5,197,646 A 3/1993 Nikolich
5,263,439 A 11/1993 Doherty et al.
6,145,724 A 11/2000 Shkolnikov et al.
7,201,301 B2 * 4/2007 Moeller ..... B25C 1/08 123/46 SC
7,290,691 B1 * 11/2007 Wen ..... B25C 1/041 227/130
7,293,684 B1 * 11/2007 Wen ..... B25C 1/045 123/46 SC
7,296,721 B1 * 11/2007 Wen ..... B25C 1/045 227/130
7,341,171 B2 3/2008 Moeller et al.
7,438,207 B2 * 10/2008 Wu ..... B25C 1/047 227/130
2007/0131731 A1 6/2007 Moeller et al.
2008/0190988 A1 * 8/2008 Pedicini ..... B25C 1/04 227/130
2009/0230166 A1 * 9/2009 Yamamoto ..... B25C 1/042 227/130
2010/0065602 A1 * 3/2010 Zhao ..... B25C 1/08 227/9
2010/0230461 A1 * 9/2010 Tanaka ..... B25C 1/08 227/9
2010/0327039 A1 * 12/2010 Adams ..... B25C 1/08 227/9
2011/0240709 A1 * 10/2011 Oouchi ..... B25C 1/08 227/8
2011/0290850 A1 * 12/2011 Wu ..... B25C 1/04 227/130
2012/0067935 A1 * 3/2012 Liu ..... B25C 1/047 227/10
2013/0134204 A1 * 5/2013 Morioka ..... B25C 1/003 227/9
2016/0151900 A1 * 6/2016 Wu ..... B25C 1/047 227/130

OTHER PUBLICATIONS

International Search Report and Written Opinion for International Application No. PCT/US2014/053948, dated Apr. 7, 2015 (16 pages).

* cited by examiner

POWERED NAILER WITH POSITIVE PISTON RETURN

RELATED APPLICATION

This application claims priority under 35 USC 119(e) from U.S. Provisional Application No. 61/889,924 filed Oct. 11, 2013.

BACKGROUND

The present disclosure relates generally to handheld power tools, and specifically to fastener driving tools, including, but not limited to combustion-powered fastener-driving tools, also referred to as combustion tools or combustion nailers, as well as pneumatic nailers and electric milers employing reciprocating driving elements and magazine feeders.

Combustion-powered tools are known in the art, and one type of such tools, also known as IMPULSE® brand tools for use in driving fasteners into workpieces, is described in commonly assigned patents to Nikolich U.S. Pat. Re. No. 32,452, and U.S. Pat. Nos. 4,522,162; 4,483,473; 4,483,474; 4,403,722; 5,197,646; 5,263,439; 6,145,724 and 7,341,171, all of which are incorporated by reference herein. Similar combustion-powered nail and staple driving tools are available commercially from ITW-Paslode of Vernon Hills, Ill. under the IMPULSE®, BUILDEX® and PASLODE® brands.

Such tools incorporate a tool housing enclosing a small internal combustion engine. The engine is powered by a canister of pressurized fuel gas, also called a fuel cell. A battery-powered electronic power distribution unit produces a spark for ignition, and a fan located in a combustion chamber provides for both an efficient combustion within the chamber, while facilitating processes ancillary to the combustion operation of the device. The engine includes a reciprocating piston with a driving element, preferably an elongated, rigid driver blade disposed within a single cylinder body. A resilient bumper is located at the bottom of the cylinder. Fasteners are fed magazine-style into the nosepiece, where they are held in a properly positioned orientation for receiving the impact of the driving element.

When the user depresses the tool against a workpiece, the tool closes the combustion chamber and fuel is delivered into the combustion chamber. After fuel/air mixing, the user activates the trigger, initiating a spark with the ignition spark unit, then the burnt gas generates a high pressure to push the piston down and drive the nail. Just prior to the piston impacting the bumper, the piston passes through the exhaust port, and some of the gas is exhaust. The tool structure absorbs heat from the remaining combusted gasses and generates vacuum pressure to retract the piston hack to the pre-firing position. Simultaneously, the fastener feeding mechanism feeds the next fastener into a pre-driving position in the nosepiece or nose (the terms are considered interchangeable). After the piston returns to the pre-firing position, the combustion chamber is opened to scavenge air for the next cycle.

One design requirement of conventional tools is that materials are selected for their heat conduction and dissipation properties. Typically, the cylinder and reciprocating valve sleeve, which largely defines the combustion chamber, are made of cast aluminum alloy, which is formed with a plurality of cooling fins for facilitating the dissipation of heat absorbed from repeated use. The use of such alloys, while considered necessary for the management of heat generated during extended tool operation, also results in a relatively heavy tool. As is well known, heavier tools result in operator fatigue after extended operation.

Another design factor of conventional combustion nailers is that the combustion chamber should remain closed, momentarily, after combustion to make sure the pressure differential in the tool is maintained for achieving piston return to the prefiring position, so that another fastener may be driven. Due to a variety of factors, including but not limited to the speed of the operator in driving fasteners, premature opening of the combustion chamber, and in some cases friction caused by the feeding mechanism urging fasteners against the driver blade, the return of the piston to the prefiring position is slowed or even stopped. While various combustion chamber lockout systems have been proposed, there is an ongoing focus on achieving proper and rapid piston return after firing.

Thus, there is a need for a combustion tool, which more effectively manages heat generated during extended use, and there is also a need for improving combustion trailers so that after firing, the drive piston is properly returned to the prefiring position.

SUMMARY

Various embodiments of the present disclosure provide a powered nailer, which is configured for allowing a combustion chamber to open as soon as the drive piston engages the bumper at the bottom of the cylinder. Instead of relying on vacuum to return the piston to the prefixing position, the piston is caused to return to the prefixing position by positive pressure formed in a supplemental tool chamber or return chamber that is in fluid communication with the underside of the piston. The return chamber is filled with air by being in fluid communication with the cylinder below the piston.

After ignition, as the piston travels down the cylinder, air under the piston is forced into the return chamber through openings in the cylinder. The pressure of this air increases as the piston moves closer to the bumper. As the piston reaches the bumper, the combustion chamber can be opened to release the combusted gasses and the relatively higher pressure air in the return chamber engages the piston, and pushes the piston back to the prefiring position. There is sufficient air in the return chamber so that some pressurized air escapes to atmosphere during the piston return process. In this way, the combustion chamber does not need to remain momentarily sealed after firing until the piston returns to the pre-firing position. Instead, through the recoil created by the fastener-driving force of the tool, the combustion chamber opens relatively quickly after ignition.

One advantage of this configuration is that the tool does not absorb the heat of the combustion gases and remains cooler during operation, which improves performance as well as user comfort. Further, the release of exhaust gases and scavenging of fresh gas for combustion preferably occurs simultaneously. In contrast to conventional combustion nailers, such release is independent of the return chamber returning the piston under positive pressure.

The powered nailer of the present disclosure operates by a user depressing the tool against a workpiece, which closes the combustion chamber in the manner of conventional nailers. After fuel and air are mixed, a spark is introduced through user action, igniting the fuel/air mixture, causing high pressure inside the combustion chamber, driving the piston and the associated driver blade downward in the cylinder, driving a fastener supplied to the tool nose via a magazine. The fastener is thus driven into the workpiece. As the piston moves down the cylinder, it pushes air under the piston into the return chamber. Once the piston reaches the bumper, driving the fastener, and the recoil force causes the user to lift the tool from the workpiece, the combustion chamber is allowed to open immediately, allowing escape of combustion gases and scavenging fresh air. The piston is rapidly returned to the pre-firing position by air stored in the return chamber.

The tool of the present disclosure is relatively lighter in weight than conventional combustion nailers, which have extensive use of finned aluminum castings for the cylinder, cylinder head and valve sleeve to dissipate heat. An advantage of the present tool is that it operates at lower temperature, allowing for use of non heat conducting materials. As such, the power-to-weight ratio of the present tool is closer to conventional pneumatic nailers, which already have a higher power-to weight-ratio over conventional combustion nailers. Furthermore, the present nailer features a cycle time that is approximately 100 msec shorter than conventional nailers.

More specifically, a powered nailer includes a power source including a driving element reciprocating within a cylinder between a prefiring position and a fastener driving position, the latter occurring when the driving element engages a bumper disposed at the bottom of the cylinder. A reciprocating valve element defines a combustion chamber in fluid communication with the cylinder, and is configured for receiving a dose of fuel and air prior to a user-generated ignition. A return chamber at least partially surrounds the cylinder and is in fluid communication with the cylinder, being configured for receiving a supply of pressurized air generated by the driving element as it moves from the prefiring position to the fastener driving position, the pressurized air acting on an underside of the driving element for returning it to the pre-firing position.

In another embodiment, a powered nailer is provided, including a combustion chamber having a plurality of ports, the same ports are used for intake of air and pre-combustion and exhaust of gases post-combustion.

In another embodiment, a powered nailer is provided, including, a cylinder having a first volume; a driving element reciprocating within the cylinder between a prefiring position and a fastener driving position; and a return chamber in fluid communication with the cylinder and having a second volume, the ratio of the second volume to the first volume being at least 1:1.

While the focus of the present disclosure is on combustion powered fastener tools, it is contemplated that features described above are applicable in other types of powered fastener driving tools, including but not limited to tools powered pneumatically, electrically, and/or by powder cartridges.

DETAILED DESCRIPTION

Figure 1:
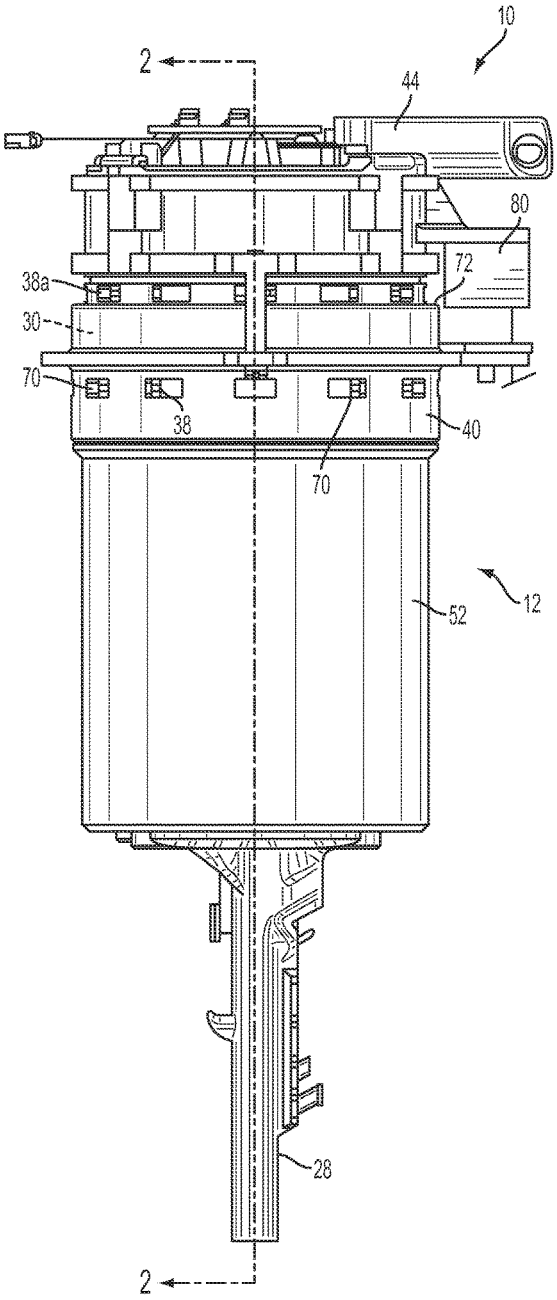
FIG. 1 is a fragmentary front view of the present tool, featuring the power source.
Figure 2:
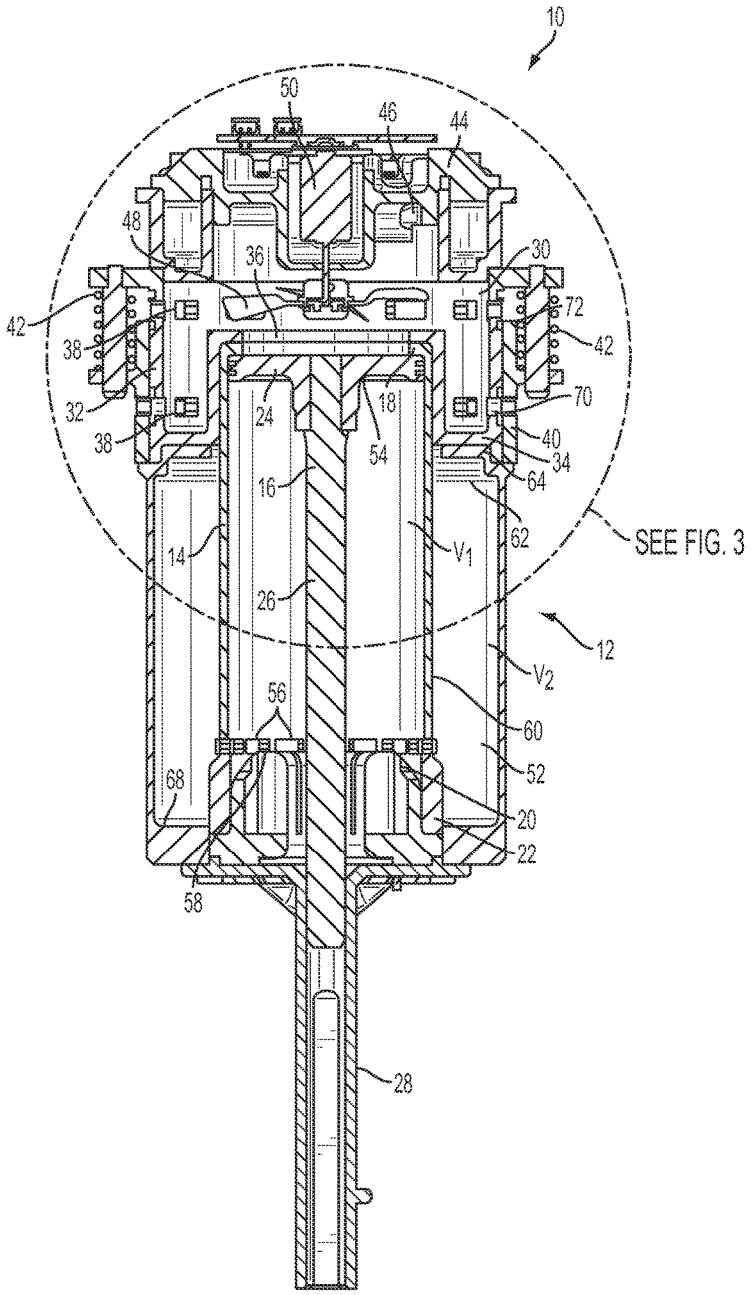
FIG. 2 is a cross-section taken along the line 2-2 of FIG. 1 and in the direction generally indicated.

Referring to FIGS. 1 and 2, a powered nailer is generally designated 10, and the basic structure of which is well known in the art, described in the patents incorporated by reference above. Such tools incorporate a tool housing enclosing a small internal combustion engine, also referred to as a power source 12. The engine 12 is powered by a canister of pressurized fuel gas, also called a fuel cell.

The power source 12 includes a cylinder 14 and a driving element 16 reciprocating within the cylinder between a prefiring position at an upper end 18 of the cylinder as seen in FIG. 2, and fastener driving position. The fastener driving position occurs when the driving element 16 engages a bumper 20 disposed at a lower end 22 or bottom of the cylinder 14. Preferably, the driving element 16 includes a radially projecting piston 24 and a depending driver blade 26, which sequentially engages fasteners (not shown) into a nosepiece 28, which depends from the lower end 22 of the cylinder 14. However, the driving element 16 may be provided in a variety of configurations besides that depicted here.

A combustion chamber 30 is in fluid communication with the cylinder 14 and is defined at a lower end by the piston 24 in the prefiring position, and also in a lateral or radial direction by a generally cylindrical outer wall 32 connected to a floor 34 defining an opening 36 communicating with the cylinder 14. Unlike conventional combustion tools, the present combustion chamber wall 32 is fixed during the entire fastener driving operational cycle. A plurality of ports 38 are formed in the wall 32.

Figure 3:
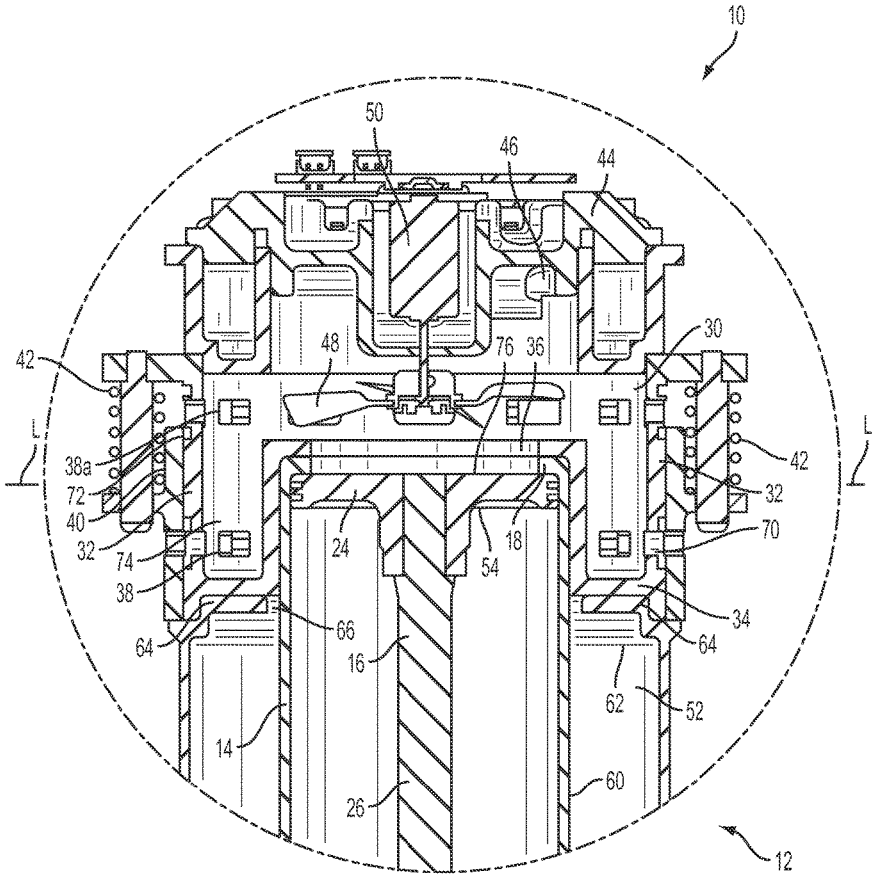
FIG. 3 is an enlarged fragmentary portion of the tool depicted in FIG. 2.

Referring now to FIGS. 2 and 3, a vertically reciprocating valve element 40 surrounds the wall 32 and is biased to an open position by at least one biasing element 42 such as a spring. The biasing force of the spring 42 is overcome by the user pressing the tool nosepiece 28 against a workpiece, which causes a mechanical linkage, such as a probe connected to a workpiece contact element (not shown) or any other suitable mechanical linkage, to move the valve element 40 to a closed position. In FIGS. 2 and 3, the valve element 40 is shown in the open position.

A cylinder head 44 defines an upper end of the combustion chamber 30, and as is known in the art, includes a spark generator or spark plug 46 as well as a fan blade 48 powered by a motor 50. Alternative configurations are contemplated for forming the upper end of the combustion chamber. The fan blade 48 projects into the combustion chamber 30 for enhancing the mixing of air and fuel vapor which are deposited into the chamber prior to a user-generated ignition caused by the spark generator 46. The fan blade 48 also facilitates the exchange of spent gases after ignition.

Referring now to FIGS. 2 and 3, a return chamber 52 is in fluid communication with the cylinder 14. The return chamber 52 is configured for receiving a supply of pressurized air generated by the driving element 16 as it moves from the prefiring position to the fastener driving position. While in the illustrated embodiment, the return chamber 52 at least partially surrounds the cylinder 14, other locations are contemplated within the tool housing, including, but not limited to a handle portion. During tool operation, after the fastener is driven into the workpiece by the driver blade, 26, the pressurized air in the return chamber 52 acts on an underside 54 of the piston 24 portion of the driving element 16 for returning the element to the pre-firing position.

Pressurized air is forced into the return chamber 52 through a plurality of circumferentially-spaced openings 56 (FIG. 2) located near the lower end 22 of the cylinder 14, preferably near an upper edge 58 of the bumper 20. The location of the openings 56 may vary to suit the application. As the piston 24 travels down the cylinder 14 under the force generated by the ignition of fuel and air in the combustion chamber 30, air caught below the underside 54 of the piston is compressed and forced through the openings 56 and into the return chamber 52.

As seen in FIGS. 2 and 3, the return chamber 52 surrounds an exterior wall 60 of the cylinder 14, and at an upper end 62, is defined in part by an annular, radially-inwardly projecting flange 64 with a seal 66 engaging the exterior wall 60. Opposite the flange 64, a lower return chamber end 68 is closed off (FIG. 2). It will be appreciated that, through the return openings 56, the return chamber 52 is also in fluid communication with atmosphere through the nosepiece 28.

After an ignition in the combustion chamber 30, the driving element 16 returns to the pre-firing position through action of pressurized air stored in the return chamber 52 simultaneously with the exhausting of the combustion chamber 30. Once the driving element 16, and specifically the piston 24 reaches the bumper 20, recoil forces created by the action of driving a nail cause the tool 10, held by a user, to move away from the workpiece. This movement allows the springs 42 to open the valve element 40, opening the chamber 30 to ambient and allowing entry of a new charge of fresh air. This operation is contrary to conventional combustion tools, where differential pressure must be maintained in the combustion chamber after combustion until the piston reaches the pre-firing position.

At the same time, the pressure of the air compressed into the return chamber 52 is greater than the pressure of the cylinder 14, which causes the air in the return chamber to push the piston 24 back up the cylinder to the pre-firing position. A portion of the compressed air from the return chamber 52 also escapes to ambient or atmosphere through the nosepiece 28. While different volumes are contemplated depending on the application, in an illustrated embodiment, the return chamber 52 is dimensioned for storing a sufficient volume of compressed air to reach approximately 8 psi.

It should be noted that, unlike conventional pneumatic nailers, in an illustrated embodiment, the cylinder 14 is continuous and aperture-free from the return openings 56 near the bumper 20 to the opening 36. Also, the valve element 40 is provided with openings 70 that are in registry with at least some of the ports 38 in the wall 32 when the valve element is in the open position shown in FIGS. 2 and 3, and out of registry when the valve element is in the closed position. The closed position is reached after vertical movement of the valve element 40 towards the cylinder head 44 just prior to combustion, as the user presses the tool 10 against a workpiece. In an illustrated embodiment, at least some of the ports 38*a* are open to ambient and are located above an upper edge 72 of the valve element 40 when the valve element is in the open position. In various embodiments, the same ports 38 are used for intake of air and pre-combustion and exhaust of gases post-combustion.

Referring now to FIG. 2, the cylinder 14 has a first volume $V_1$, and the return chamber 52 has a second volume $V_2$, the ratio of the second volume to the first volume being at least 1:1. In the preferred embodiment, the ratio is approximately 2:1.

Referring again to FIG. 3, in the illustrated embodiment, the combustion chamber 30 has a portion 74 extending below a line "L" defined by an upper edge 76 of the piston 24 of the driving element 16 at the pre-firing position. During tool operation, the floor 34 of the combustion chamber 30 is in contact with the annular flange 64, and both components remain fixed during the fastener driving cycle. Alternate configurations are contemplated for the connection between, and the relative positions of, the combustion chamber 30 and the return chamber 52.

As an option, a mechanical or electro-mechanical delay mechanism 80 (FIG. 1), such as a solenoid with plunger under control of a tool control program. (not shown), is disposed in operational relationship to the valve element 40 for delaying the opening of the combustion chamber 30 post-ignition. Specifically, the delay mechanism 80 is configured for opening the combustion chamber 30 before return of the driving element 16 to the prefiring position.

Figure 4:
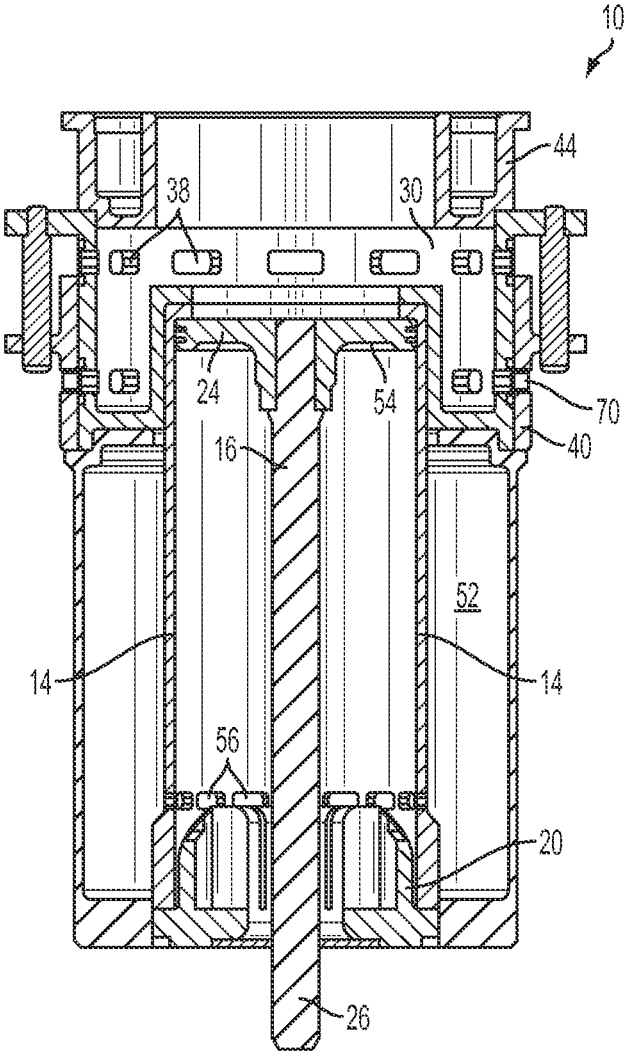
FIG. 4 is a fragmentary vertical cross-section of the present tool, shown in the rest position.

Referring now to FIGS. 4-8, the sequential operation of the tool 10 of the present disclosure is depicted. FIG. 4 shows the tool in its rest state or position, similar to FIGS. 2 and 3 discussed above. The valve element 40 is in the open position, allowing exchange of air within the combustion chamber 30. Also, the driving element 16, including the piston 24 is in the prefiring position.

Figure 5:
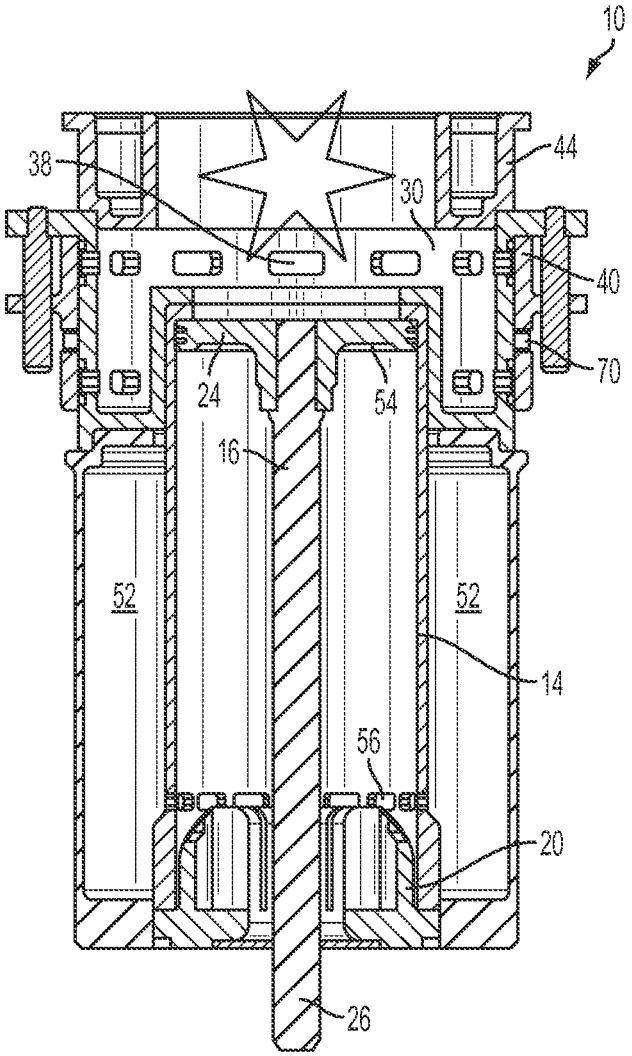
FIG. 5 is a fragmentary vertical cross-section of the present tool, shown in the ignition position.

Referring to FIG. 5, the tool 10 has been pressed against a workpiece, and the valve element 40 is in the closed position, sealing the combustion chamber 30. Fuel is introduced into the combustion chamber, and a spark ignites the air-fuel mixture. The return pressure 52 is open to atmosphere.

Figure 6:
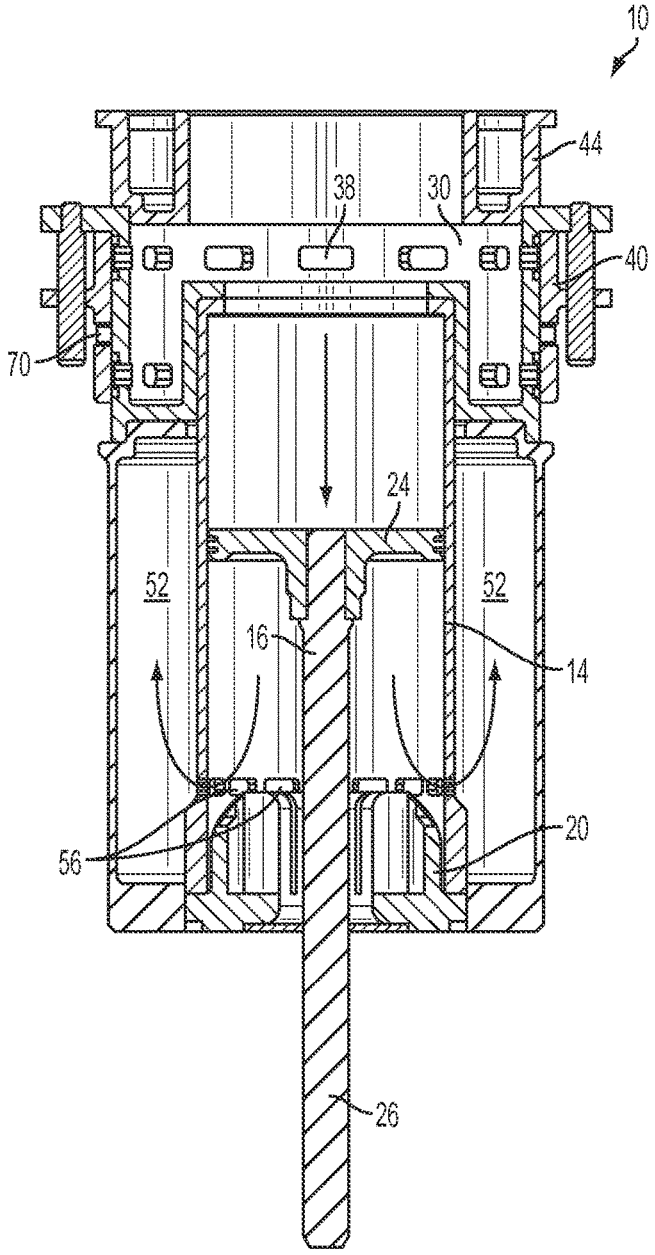
FIG. 6 is a fragmentary vertical cross-section of the present tool, shown in the fastener driving position.

Referring now to FIG. 6, the combustion gases urge the driving element 16 down to begin driving a fastener. The combustion chamber 30 remains sealed by the valve element 40. Air volume beneath the piston 24 is reduced, increasing the pressure of air in this space. The increase of air pressure forces air into the return chamber 52 via the return openings 56. At this point, about 4 msec has transpired since ignition.

Figure 7:
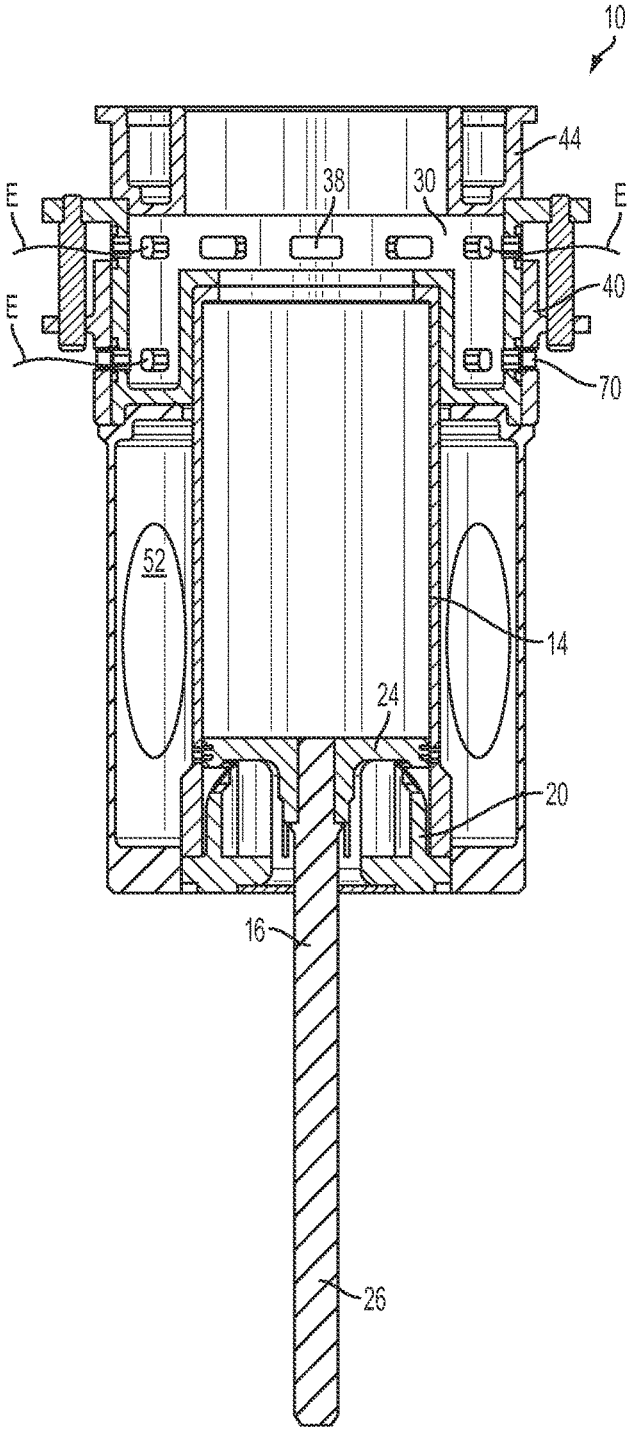
FIG. 7 is a fragmentary vertical cross-section of the present tool shown where the nail has been driven and the combustion chamber opens.

Referring now to FIG. 7, the driving element 16 has completed its stroke, and the driving of the nail is completed. Thus, the combustion chamber 30 is opened by return of the valve element 40 to the rest position through tool recoil. Exhaust E passes through the openings 38, 70. This relatively rapid exhaust of gases significantly reduces heat buildup in the tool 10, allowing use of unconventional materials in tool construction. In the return chamber 52, the air has reached the maximum pressure, preferably 8 psi, and volume is at a minimum for the tool size. At this point in the cycle 8 msec have elapsed since ignition.

Figure 8:
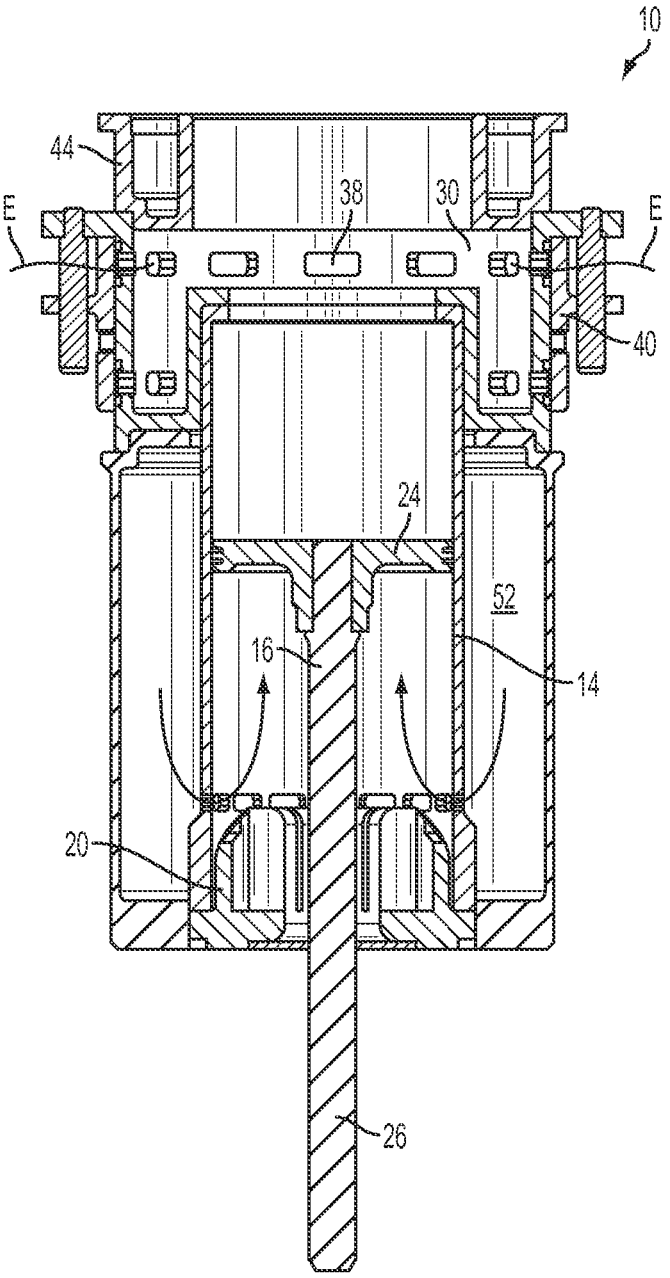
FIG. 8 is a fragmentary vertical cross-section of the present tool shown with the piston returning via pressure in the return chamber.

Referring now to FIG. 8, as the relatively high pressure exhaust gases leave the still open combustion chamber 30, the stored air in the return chamber 52 pushes the driving element 16 back to the prefiring position seen in FIG. 4. Approximately 4 psi of air pressure is needed for achieving piston return. At this point, approximately 20 msec have transpired since ignition. Following piston return, the tool 10 resumes the rest position seen in FIG. 4. While the focus of the present disclosure is on combustion powered fastener tools, it is contemplated that features described above are applicable in other types of powered fastener driving tools, including but not limited to tools powered pneumatically, electrically, and/or by powder cartridges.

While a particular embodiment of the present powered nailer with positive piston return has been shown and described, it will be appreciated by those skilled in the art that changes and modifications may be made thereto without departing from the disclosure in its broader aspects and as set forth in the following claims.

What is claimed:

1. A powered nailer comprising:

a power source including a driving element reciprocatable within a cylinder between a pre-firing position and a fastener driving position, the driving element being in the fastener driving position when the driving element engages a bumper disposed at a bottom of the cylinder;

an outer wall partially defining a combustion chamber in fluid communication with said cylinder, the combustion chamber configured to receive a dose of fuel and air prior to a user-generated ignition;

a valve element at least partially surrounding the outer wall and reciprocatable relative to the outer wall; and a return chamber in fluid communication with said cylinder via a plurality of openings between the return chamber and the cylinder, wherein the plurality of openings are circumferentially-spaced about the cylinder, and wherein the return chamber:

receives a supply of pressurized air through the plurality of openings, wherein the pressurized air is generated by said driving element as said driving element moves from the pre-firing position to the fastener driving position; and releases the pressurized air through the plurality of openings to act on an underside of said driving element to return said driving element to the pre-firing position.

2. The nailer of claim 1 wherein said combustion chamber is configured such that, after an ignition in said combustion chamber, said driving element returns to the pre-firing position through action of the pressurized air stored in said return chamber simultaneously with exhausting of the combustion chamber.

3. The nailer of claim 1, wherein said return chamber is defined in part by an annular, radially-inwardly projecting flange with a sealing relationship to an exterior wall of said cylinder.

4. The nailer of claim 1 wherein said combustion chamber is configured to open to atmosphere upon said driving element reaching said bumper.

5. The nailer of claim 4, wherein said return chamber is sized to store sufficient pressurized air to push said driving element to the pre-firing position, and wherein the nailer is configured such that post fastener-driving tool recoil automatically opens said combustion chamber post firing.

6. The nailer of claim 1 further including a mechanism configured to delay opening of said combustion chamber post-ignition and configured to open said combustion chamber before return of said driving element to the pre-firing position.

7. The nailer of claim 1 wherein the return chamber has a pressure of 8 psi when the driving element is in the fastener driving position.

8. The nailer of claim 1 wherein said cylinder is continuous from an upper end adjacent the pre-firing position to a bumper area at an opposite end from said upper end.

9. A powered nailer comprising:

a cylinder;

a driving element reciprocatable within the cylinder;

an outer wall partially defining a combustion chamber in fluid communication with the cylinder, the outer wall defining a plurality of ports in fluid communication with the combustion chamber; and a reciprocating valve element surrounding the outer wall, movable between an open position before and after combustion occurs, and a closed position during combustion, wherein each of the ports enables both intake of air before combustion occurs in the combustion chamber and exhaust of gases after combustion occurs in the combustion chamber, while the reciprocating valve element is in the open position.

* * * * *